US007274139B2

(12) United States Patent
Lee

(10) Patent No.: US 7,274,139 B2
(45) Date of Patent: Sep. 25, 2007

(54) ELECTRON EMISSION DEVICE WITH IMPROVED ELECTRON EMISSION SOURCE STRUCTURE

(75) Inventor: Sang-Jin Lee, Suwon-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 375 days.

(21) Appl. No.: 10/980,677

(22) Filed: Nov. 2, 2004

(65) Prior Publication Data

US 2005/0189865 A1 Sep. 1, 2005

(30) Foreign Application Priority Data

Feb. 26, 2004 (KR) ..... 10-2004-0012951

(51) Int. Cl.
*H01J 1/62* (2006.01)
*H01J 63/04* (2006.01)

(52) U.S. Cl. ..... 313/496; 313/495; 313/310; 313/346 R

(58) Field of Classification Search ..... 313/495–497, 313/309–311, 336, 346 R, 351
See application file for complete search history.

(56) References Cited

U.S. PATENT DOCUMENTS 6,028,391 A * 2/2000 Makishima ..... 313/310
6,437,503 B1 * 8/2002 Konuma ..... 313/495
6,563,260 B1 * 5/2003 Yamamoto et al. ..... 313/495
6,922,014 B2 * 7/2005 Oh et al. ..... 313/495
6,946,787 B2 * 9/2005 Oh ..... 313/497
2002/0003399 A1 * 1/2002 Uemura et al. ..... 313/495
2003/0193297 A1 * 10/2003 Russ et al. ..... 315/169.3

FOREIGN PATENT DOCUMENTS

JP 11-345561 12/1999

(Continued)

OTHER PUBLICATIONS

Patent Abstracts of Japan, Publication No.: 11-345561; Publication Date: Dec. 14, 1999; in the name of Tsuburaya et al.

(Continued)

*Primary Examiner*—Nimeshkumar D. Patel
*Assistant Examiner*—Kevin Quarterman
(74) *Attorney, Agent, or Firm*—Christie, Parker & Hale, LLP

(57) ABSTRACT

An electron emission device includes cathode electrodes and gate electrodes formed on a first substrate and crossing each other while interposing an insulation layer. Opening portions are formed at the gate electrodes and the insulation layer while exposing the cathode electrodes. Electron emission sources are formed on the cathode electrodes exposed through the opening portions each with an area smaller than the area of the opening portion. An anode electrode is formed on a second substrate. Phosphor layers are formed on the anode electrode with a length extending in a first direction and a width extending in a second direction. Each electron emission source satisfies the following condition: a<b. In the condition, "a" indicates the distance between the electron emission source and the gate electrode in the first direction, and "b" indicates the distance between the electron emission source and the gate electrode in the second direction.

15 Claims, 6 Drawing Sheets

FOREIGN PATENT DOCUMENTS

| | | |
|---|---|---|
| JP | 2000-243218 | 9/2000 |
| JP | 2000-285794 | 10/2000 |
| JP | 2002-324501 | 11/2002 |
| JP | 2003-16912 | 1/2003 |
| JP | 2003-16919 | 1/2003 |
| JP | 2003-151456 | 5/2003 |
| JP | 2003-203554 | 7/2003 |

OTHER PUBLICATIONS

Patent Abstracts of Japan, Publication No.: 2000-243218; Publication Date: Sep. 8, 2000; in the name of Konuma et al.

Patent Abstracts of Japan, Publication No.: 2000-285794; Publication Date: Oct. 13, 2000; in the name of Nakada et al.

Patent Abstracts of Japan, Publication No.: 2002-324501; Publication Date: Nov. 8, 2002; in the name of Nakada.

Patent Abstracts of Japan, Publication No.: 2003-016912; Publication Date: Jan. 17, 2003; in the name of Fujiwara.

Patent Abstracts of Japan, Publication No.: 2003-016919; Publication Date: Jan. 17, 2003; in the name of Teramoto.

Patent Abstracts of Japan, Publication No.: 2003-151456; Publication Date: May 23, 2003; in the name of Urazono.

Patent Abstracts of Japan, Publication No.: 2003-203554; Publication Date: Jul. 18, 2003; in the name Tottori.

* cited by examiner

ELECTRON EMISSION DEVICE WITH IMPROVED ELECTRON EMISSION SOURCE STRUCTURE

CROSS REFERENCE TO RELATED APPLICATION

This application claims priority to and the benefit of Korea Patent Application No. 2004-0012951 filed on Feb. 26, 2004 in the Korean Intellectual Property Office, the content of which is incorporated herein by reference.

BACKGROUND OF THE INVENTION (a) Field of the Invention

The present invention relates to an electron emission device, and in particular, to an electron emission device which has an electron emission source with an improved pattern to minimize the diffusion of electron beams, and enhance the screen color representation.

(b) Description of Related Art

Generally, the electron emission devices are classified into a first type where a hot cathode is used as an electron emission source, and a second type where a cold cathode is used as the electron emission source.

Among the second type electron emission devices there are field emitter array (FEA) types, surface conduction emitter (SCE) types, metal-insulator-metal (MIM) types, metal-insulator-semiconductor (MIS) types, and ballistic electron surface emitting (BSE) types.

With the FEA type, the electron emission source is formed with a material emitting electrons under the application of voltage, whereby the electrons strike the phosphors to emit light. The overall quality of the FEA type electron emission device is largely influenced by the characteristics of the electron emitters.

With the common FEA type, the emitters are formed on the rear substrate together with electrodes for controlling the electron emission of the emitters, such as cathodes and gate electrodes. An anode electrode and phosphor layers are formed on the surface of the front substrate facing the rear substrate.

FIG. 10 is a partial sectional view of a FEA typed electron emission device with front and rear substrates according to a prior art, and FIG. 11 is a plan view of the rear substrate shown in FIG. 10. As shown in the drawings, cathode electrodes 3 and gate electrodes 7 are formed on rear substrate 1 in a stripe pattern, and cross each other while interposing insulation layer 5. Openings 9 are formed at gate electrodes 7 and insulation layer 5 in respective crossed regions of cathode and gate electrodes 3, 7. Emitters 11 are formed on the surface portions of cathode electrodes 3 exposed through openings 9.

Anode electrode 15 is formed on the surface of front substrate 13 facing rear substrate 1, and red, green and blue phosphor layers 17R, 17G, 17B are formed on anode electrode 15 while interposing black layer 19.

Typically, phosphor layers 17R, 17G, 17B are formed in a stripe or slit pattern, which has a longitudinal side proceeding in the direction of the short axis of front substrate 13 (in the Y direction of the drawing). Each crossed region of cathode and gate electrodes 3, 7 corresponds to one of the phosphor layers while forming a sub-pixel, and three sub-pixels corresponding to the red, green and blue phosphor layers 17R, 17G, 17B collectively form one pixel.

In the above structure, openings 9 formed at gate electrodes 7 and insulation layer 5 as well as emitters 11 placed within openings 9 are formed in a circular shape. With circular-shaped emitter 11, when a predetermined driving voltage is applied to cathode electrode 3 and gate electrode 7 to emit electrons from emitter 11, the electron emission efficiency of emitter 11 is enhanced, thereby lowering the driving voltage.

However, with the structure where opening 9 and emitter 11 are circular-shaped, emitter 11 is spaced apart from gate electrode 7 at the same distance along the periphery thereof so that the electron beams from emitter 11 are diffused in a radial manner. Consequently, the electron beams emitted from emitter 11 may not land on the phosphor at the relevant sub-pixel, but may strike incorrect phosphors, thereby deteriorating the screen color representation.

Accordingly, in order to enhance the screen color representation through inhibiting the diffusion of electron beams, opening 9 and emitter 11 placed within the opening need to be reduced in their sizes, and electrodes for focusing the electron beams need to be formed separately. However, in this case, the structure of the device becomes complex which can result in processing difficulties.

SUMMARY OF THE INVENTION

In one exemplary embodiment of the present invention, there is provided an electron emission device which minimizes the diffusion of electrons from the emitter toward not the phosphor at the relevant sub-pixel but incorrect phosphors to enhance the screen color representation.

In an exemplary embodiment of the present invention, an electron emission device includes first and second substrates facing each other with a predetermined distance therebetween. Cathode electrodes and gate electrodes are formed on the first substrate and cross each other while interposing an insulation layer. Opening portions are formed at the gate electrodes and the insulation layer while exposing the cathode electrodes. Electron emission sources are formed on the cathode electrodes exposed through the opening portions each with an area smaller than the area of the opening portion. An anode electrode is formed on the second substrate. Phosphor layers are formed on the anode electrode each with long sides proceeding in a first direction, and short sides proceeding in a second direction.

When the first substrate is viewed from the plan side, the electron emission source satisfies the following condition: $a<b$ where "a" indicates the distance between the electron emission source and the gate electrode in the first direction, and "b" indicates the distance between the electron emission source and the gate electrode in the second direction.

The opening portion and the electron emission source have long sides proceeding in the second direction, and short sides proceeding in the first direction. Two or more of the opening portions and the electron emission sources are arranged at the crossed regions of the cathode electrodes and the gate electrodes parallel to each other while proceeding in the first direction.

The opening portions include a first opening portion formed at the insulation layer and a second opening portion formed at the gate electrode, and the second opening portion has an extension exposing the surface of the insulation layer. When the first opening portion is formed with a rectangular-shaped section, the extension of the second opening portion is placed between the long-sided edges of the first opening portion.

The electron emission source is formed with a carbon-based material, which is selected from carbon nanotube, graphite, diamond, diamond-like carbon, $C_{60}$ (fulleren), or combinations thereof. Ohterwise, the electron emission source is formed with a nanometer size material which is selected from nano-tube, nano-fiber, nano-wire, or combination thereof.

A grid electrode is placed between the first and the second substrates with electron beam-guide holes. The holes of the grid electrode are arranged at the sub-pixel regions defined over the first substrate one to one correspondence.

DETAILED DESCRIPTION

Figure 1:
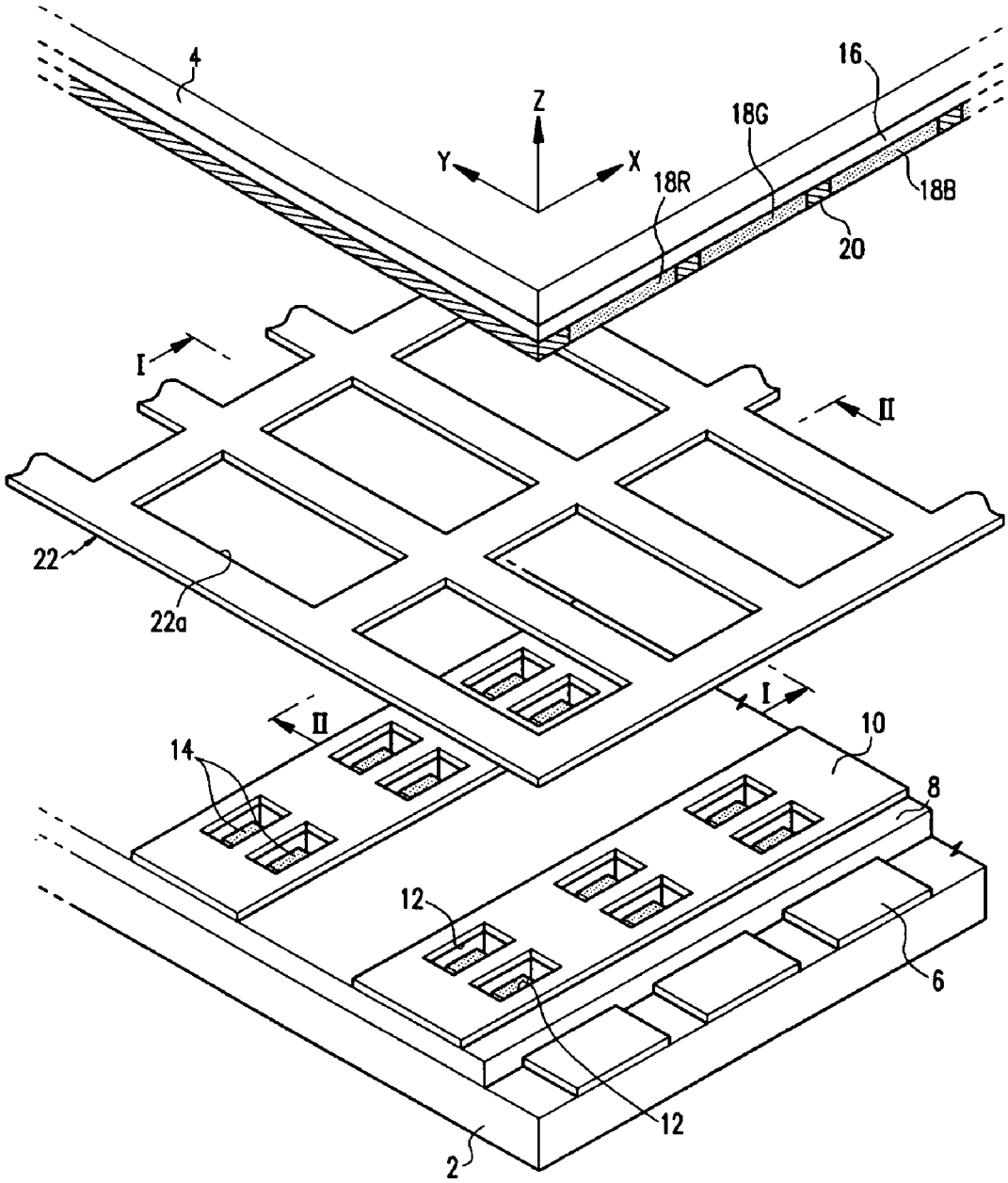
FIG. 1 is a partial exploded perspective view of an electron emission device with first and second substrates according to an embodiment of the present invention.
Figure 2:
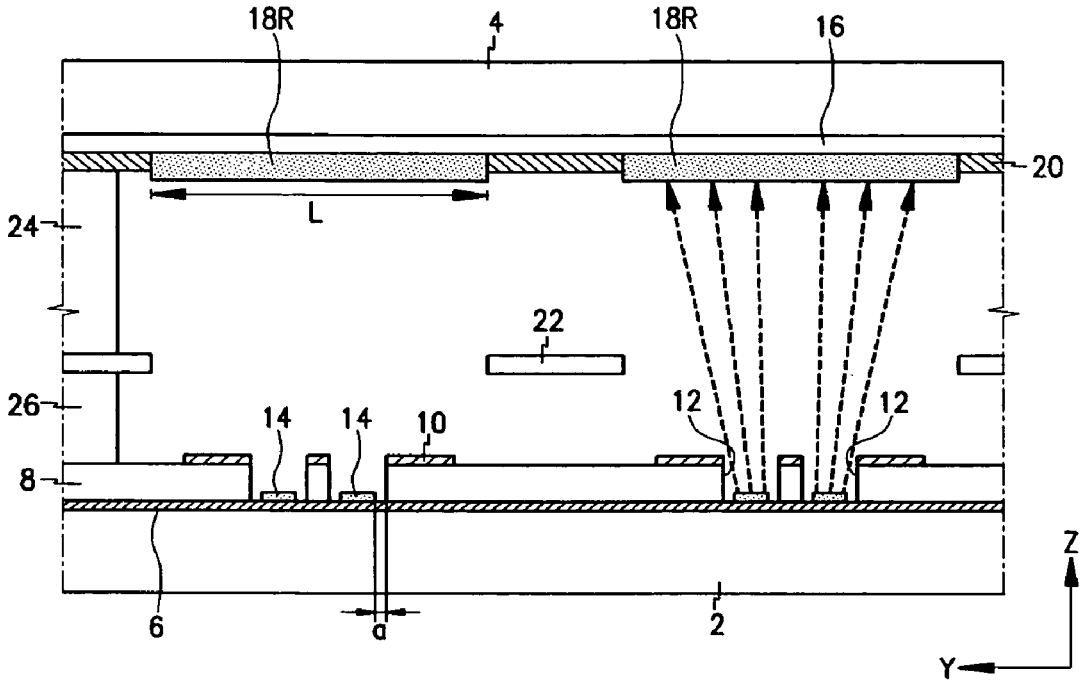
FIGS. 2 and 3 are cross sectional views of the electron emission device taken along the I-I line and the II-II line of FIG. 1, illustrating the combinatorial state thereof.
Figure 3:
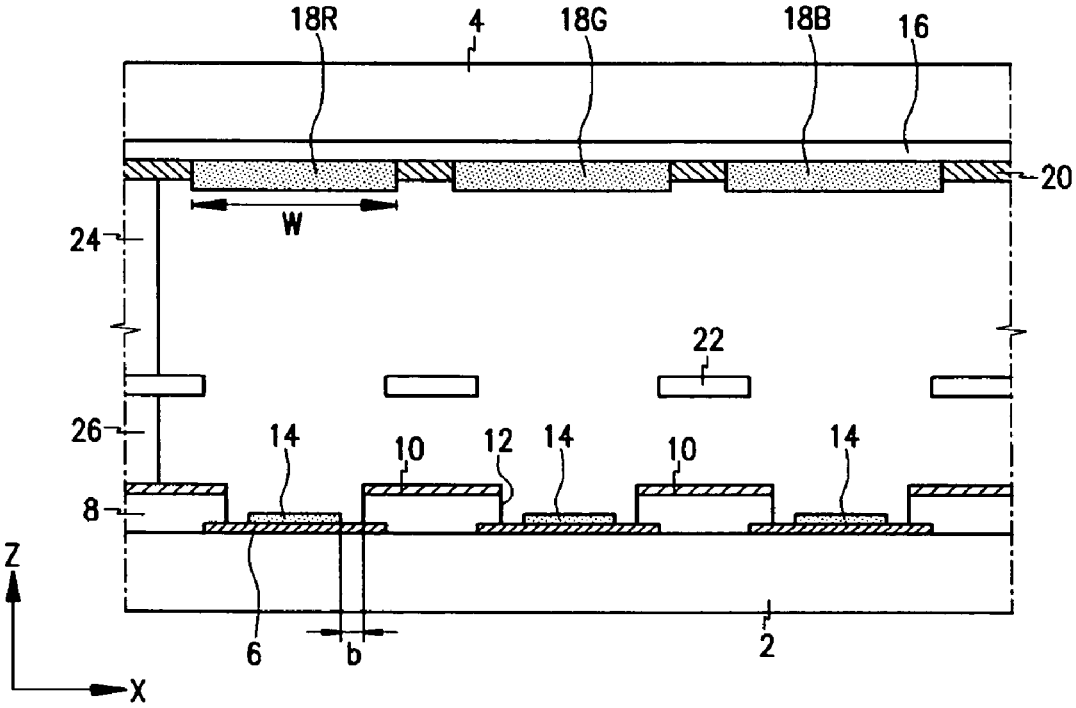

As shown in the FIGS. 1-3, wherein an FEA type is illustrated the electron emission device has first and second substrates 2, 4 sealed to each other at their peripheries by a sealant (not shown), such as frit, to form a vacuum vessel. A structure for emitting electrons upon formation of electric fields is provided at first substrate 2, and a structure of displaying the desired images due to light emission caused by the electrons is provided at second substrate 4.

Specifically, cathode electrodes 6 are formed on first substrate 2 in a stripe pattern while proceeding in a direction (in the Y direction of the drawing), and insulation layer 8 is formed on the entire inner surface of first substrate 2 while covering cathode electrodes 6. Gate electrodes 10 are formed on insulation layer 8 while proceeding in the direction crossing cathode electrodes 6 (in the X direction of the drawing), and openings 12 are formed at the respective crossed regions of the cathode and gate electrodes 6 and 10 while penetrating gate electrodes 10 and insulation layer 8.

Emitters 14 are formed on the surface portions of cathode electrodes 6 exposed through the openings to function as electron emission sources. In this embodiment, emitter 14 is formed with an area smaller than that of respective opening 12, and spaced apart from insulation layer 8 and gate electrode 10 a predetermined distance while proceeding along the longitudinal direction of first substrate 2.

In this embodiment, emitter 14 is formed with a carbonaceous material, such as carbon nanotube, graphite, diamond, diamond-like carbon, $C_{60}$ (fulleren), or combinations thereof. Otherwise, emitter 14 is formed with a nanometer size material, such as nano-tube, nano-wire, nano-fiber, or a combination thereof. However, the shape and the material of the emitter are not limited thereto.

Anode electrode 16 is formed on the surface of second substrate 4 facing first substrate 2, and red, green and blue phosphor layers 18R, 18G, 18B are formed on anode electrode 16 while interposing black layer 20. Anode electrode 16 is formed with a transparent conductive material, such as indium tin oxide (ITO).

A metallic layer (not shown) may be formed on phosphor layers 18R, 18G, 18B and black layer 20 to enhance the screen brightness due to the metal back effect. In this case, the metallic layer may be used as an anode electrode without forming the transparent electrode separately.

Respective phosphor layers 18R, 18G, 18B are formed in a stripe or slit pattern, which has a longitudinal side in the direction of the short axis of second substrate 4 (in the Y direction of the drawing). It is illustrated in the drawings that the phosphor layer is slit-shaped with width W proceeding along the long axis of second substrate 4 (in the X direction of the drawing), and length L proceeding along the short axis of the second substrate 4 (in the Y direction of the drawing). The direction of the length of phosphor layers 18R, 18G, 18B will be hereinafter referred to as the "first direction," and the direction of the width thereof as the "second direction."

In the above-described structure, each crossed region of the cathode and gate electrodes 6, 10 is located corresponding to one phosphor layer to form a sub-pixel, and three sub-pixels corresponding to red, green and blue phosphor layers 18R, 18G, 18B collectively form one pixel.

In this embodiment, openings 12 and emitters 14 are shaped corresponding to the pattern of the phosphor layers 18R, 18G, 18B to minimize the mislanding of the electron beams on incorrect phosphor layers.

Figure 4:
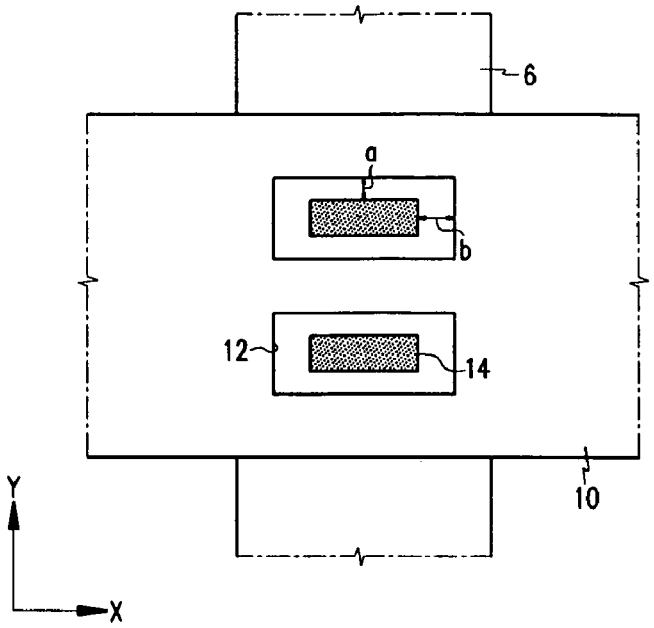
FIG. 4 is a partial plan view of the first substrate shown in FIG. 1.

FIG. 4 is a partial plan view of the first substrate shown in FIG. 1, illustrating one example sub-pixel region. As shown in FIG. 4, opening 12 is rectangular-shaped with a long side proceeding in the second direction (in the X direction of the drawing), and a short side proceeding in the first direction (in the Y direction of the drawing). Emitter 14 placed within opening 12 is also rectangular-shaped corresponding to the shape of opening 12. When the first substrate is viewed from the plan side, emitter 14 is formed to satisfy the following mathematical formula:

$$a<b \tag{1}$$

where "a" indicates the distance between emitter 14 and gate electrode 10 in the first direction, and "b" indicates the distance between emitter 14 and gate electrode 10 in the second direction.

Emitter 4 is structured such that the distance "b" between emitter 14 and the gate electrode 10 measured in the direction of the width of the phosphor layer (in the second direction) is larger than the distance "a" between emitter 14 and gate electrode 10 measured in the direction of the length of the phosphor layer (in the first direction). This is to inhibit the diffusion of the electron beams in the second direction, which, during the driving of the device, weakens the intensity of the electric field applied to the two short-sided peripheries of emitter 14, and induces the hitting of the incorrect phosphor layers.

In this embodiment, the two long-sided peripheries of the emitter are arranged close to gate electrode 10 to reinforce the intensity of the electric field applied to the two long-sided peripheries, and increase the emission efficiency thereof. The long-sided periphery of the emitter has a length larger than the short-sided periphery thereof so that the electron emission area becomes enlarged. Further, two or more of the above-patterned openings 12 and emitters 14 are arranged at the respective sub-pixel region in the first direction to redouble the emission efficiency.

Grid electrode 22 may be positioned between first and second substrates 2, 4 to focus the electron beams. Grid electrode 22 is a metallic plate with electron beam-guide holes 22*a*, and placed within the vacuum vessel while being spaced apart from first and second substrates 2, 4 by a plurality of upper and lower spacers 24, 26. Beam-guide holes 22*a* are arranged at the respective sub-pixel regions defined over first substrate 2 in a one to one correspondence.

With the above structure, when a predetermined driving voltage is applied to cathode electrode 6 and gate electrode 10, an electric field is formed around emitter 14 due to the voltage difference between the two electrodes so that electrons are emitted from the emitter. The emitted electrons are attracted by the positive (+) voltage applied to the grid electrode 22, and directed toward second substrate 4 while passing through holes 22*a* of grid electrode 22. The electrons are then attracted by the high voltage applied to anode electrode 16, and land on the corresponding phosphor layer at the relevant sub-pixel, thereby emitting light and displaying the desired images.

Emitter 14 weakens the intensity of the electric field applied to the short-sided peripheries of emitter 14 with the shaping condition of a<b, and inhibits the emission of electron beams in the second direction as well as the diffusion thereof. Furthermore, emitter 14 reinforces the intensity of the electric field applied to the two long-sided peripheries of emitter 14, and increases the electron emission in the first direction, thereby heightening the emission efficiency, and enhancing the light emission degree within phosphor layers 18R, 18G, 18B.

Figure 5:
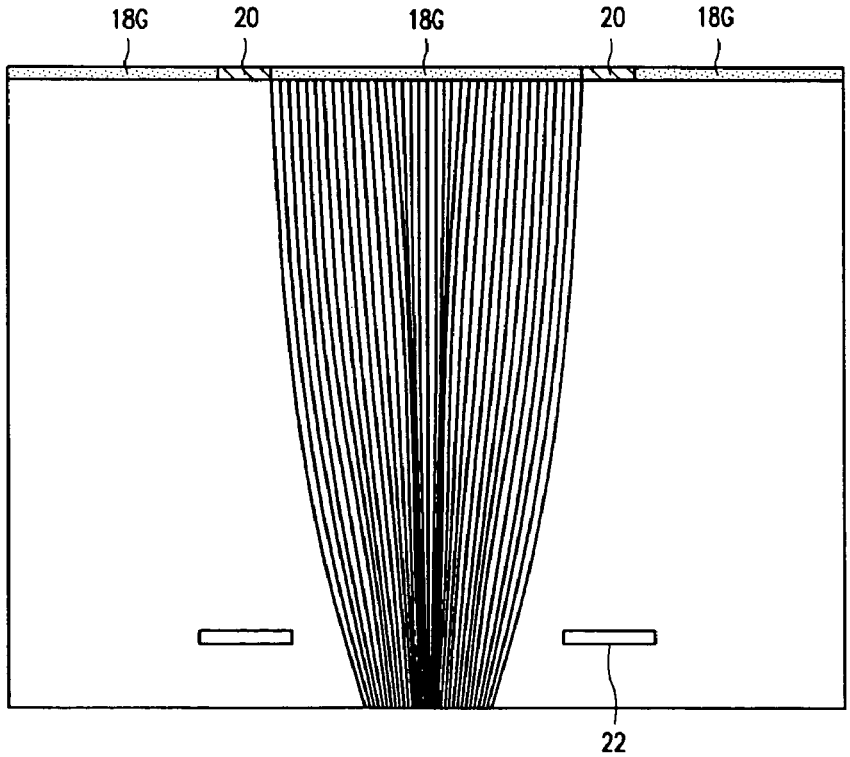
FIGS. 5 and 6 are partial sectional views of the electron emission device, illustrating the trajectories of the emitted electrons in first and second directions.
Figure 6:
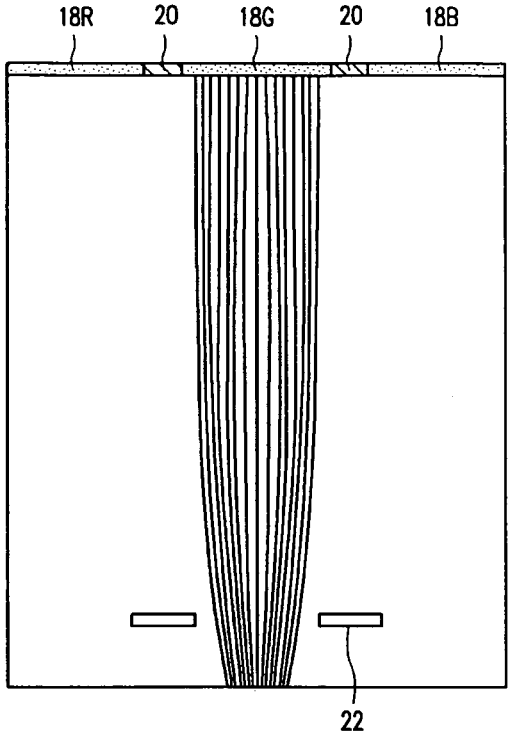

FIGS. 5 and 6 are partial sectional views of an electron emission device, illustrating the trajectories of the emitted electrons in the first and the second directions. With the electron emission device used in the electron beam emission experiment, two emitters 14 are arranged at one sub-pixel region in the first direction. The trajectories of the electrons beams shown in FIGS. 5 and 6 are obtained with the conditions in that 0V is applied to cathode electrode 6, 120V to gate electrode 10, 150V to grid electrode 22, and 4 kV to anode electrode 16.

As shown in the drawings, the diffusion of the electron beams emitted from emitter 14 in the second direction is inhibited while minimizing the hitting of the incorrect phosphor layers, and the electron beams correctly land on phosphor layer 18G at the relevant sub-pixel. Accordingly, with the electron emission device according to the embodiment of the present invention, the screen color representation is enhanced, and the efficiency of the electron emission in the first direction is increased, thereby enhancing the light emission degree of the phosphor layers.

Figure 7:
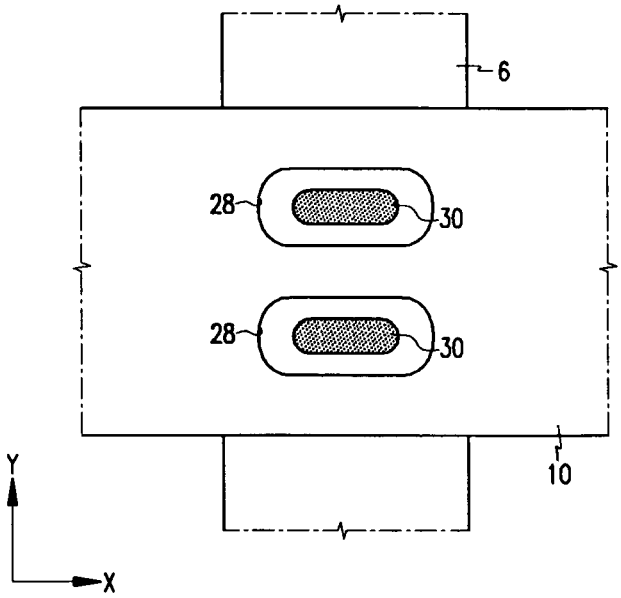
FIGS. 7 to 9 are partial plan views of the first substrate, illustrating variations of the opening and the emitter.
Figure 8:
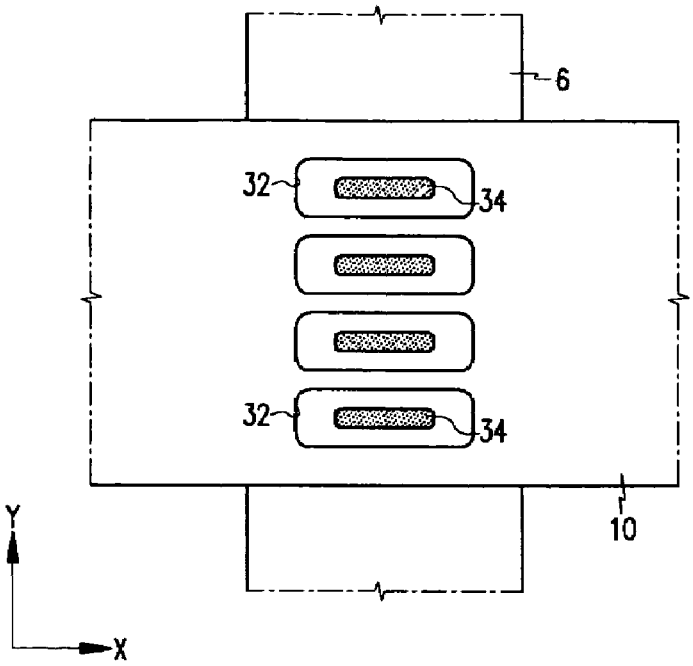

Further, as shown in FIG. 7, opening 28 and emitter 30 may be oval-shaped with long sides proceeding in the second direction (in the X direction of the drawing) and short sides proceeding in the first direction (in the Y direction of the drawing). As shown in FIG. 8, two or more (and in one exemplary embodiment, four) of openings 32 and emitters 34 may be arranged at one sub-pixel region.

Figure 9:
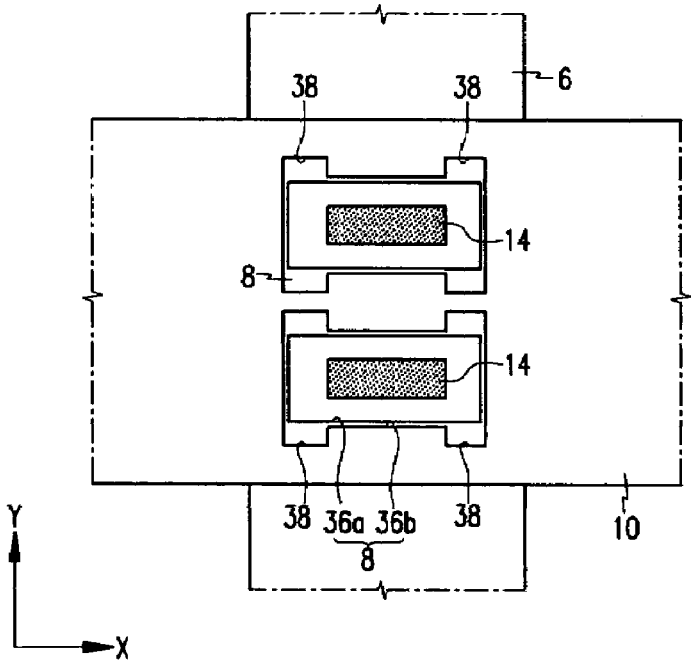
Figure 10:
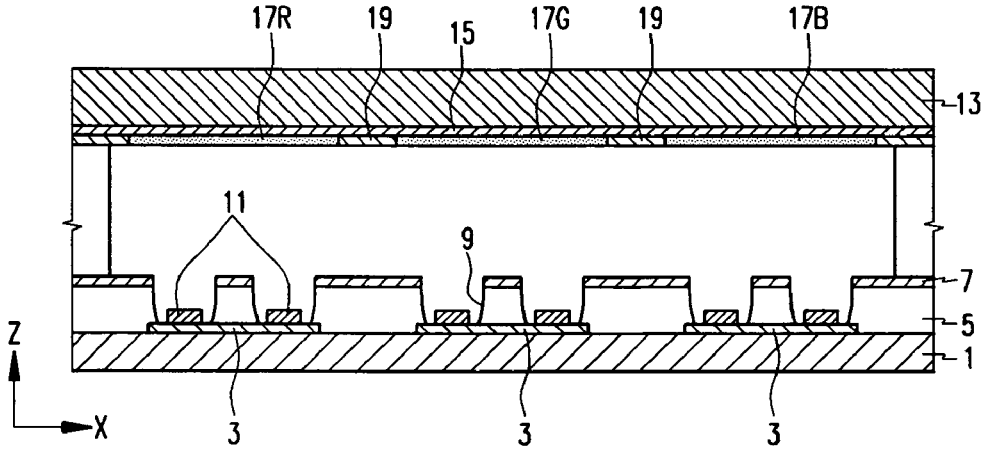
FIG. 10 (Prior Art)
FIG. 10 is a partial sectional view of an electron emission device with front and rear substrates according to a prior art.
Figure 11:
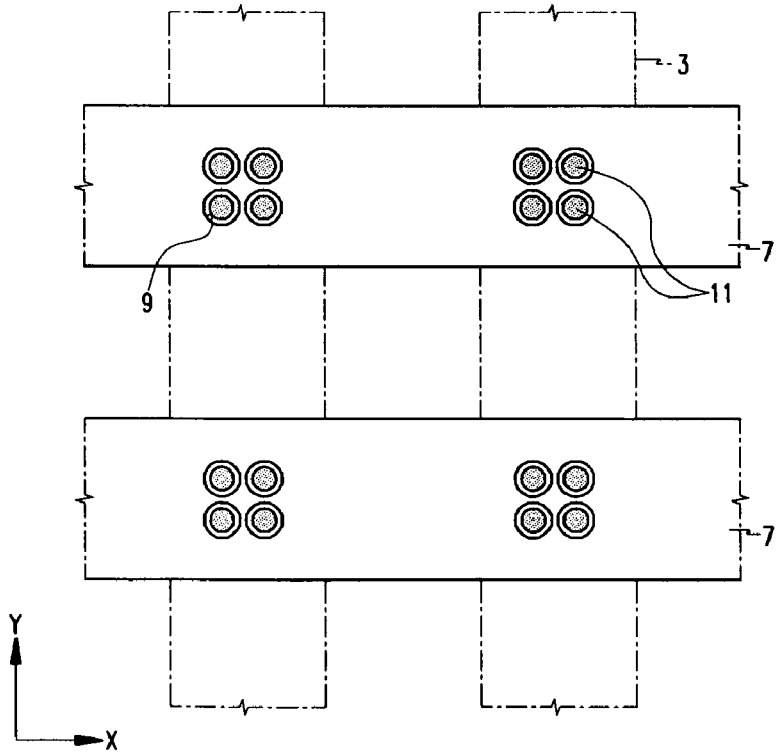
FIG. 11 (Prior Art)
FIG. 11 is a plan view of the rear substrate shown in FIG. 10.

Also, as shown in FIG. 9, the influence of the gate electrode to the corners of the emitter may be reduced to inhibit the diffusion of electron beams more effectively. That is, as shown in FIG. 9, openings 36 may include first opening portions 36*a* formed at insulation layer 8, and second opening portions 36*b* formed at gate electrodes 10, which have extensions 38 exposing the surface of the insulation layer 8.

Extensions 38 are located at the long-sided edges of first opening portion 36*a* while making the whole plane shape of the second opening portion 36*b* like a dumbbell. In this way, when extensions 38 are made while increasing the distance between emitter 14 and gate electrode 10 at the long-sided edges of the first opening portion 36*a*, the intensity of the electric field at the corners of the emitter 14 can be weakened while inhibiting the diffusion of electron beams more effectively.

As described above, with the electron emission device according to the embodiment of the present invention, when electron beams are emitted from the emitter, the diffusion of beams in the direction of the width of the phosphor layers is inhibited while minimizing the hitting of the incorrect phosphor layers. Accordingly, the screen color representation is enhanced, and the emission efficiency in the direction of the length of the phosphor layer is increased to heighten the light emission degree of the phosphor layer and the screen brightness.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising:

a first substrate and a second substrate facing each other at a predetermined distance;

cathode electrodes and gate electrodes formed on the first substrate and crossing each other with an insulation layer interposed between the cathode electrodes and the gate electrodes;

opening portions formed at the gate electrodes and at the insulation layer exposing the cathode electrodes;

electron emission sources formed on cathode electrodes exposed through the opening portions, each electron emission source having an area smaller than an area of each opening portion;

an anode electrode formed on the second substrate; and phosphor layers formed on the anode electrode, each phosphor layer having a phosphor layer length extending in a first direction and a phosphor layer width extending in a second direction, the phosphor layer length being greater than the phosphor layer width;

wherein the electron emission sources satisfy the following condition:

$$a<b,$$

where "a" indicates a distance between each electron emission source and a respective gate electrode in the first direction, and "b" indicates a distance between each electron emission source and the respective gate electrode in the second direction.

2. The electron emission device of claim 1, wherein the opening portions each have an opening portion length extending in the second direction, and an opening portion width extending in the first direction, the opening portion length being greater than the opening portion width.

3. The electron emission device of claim 1, wherein the opening portions and the electron emission sources each have an opening portion length and an electron emission source length, respectively, extending in the second direction, and an opening portion width and an electron emission source width, respectively, extending in the first direction, the opening portion length being greater than the opening portion width, and the electron emission source length being greater than the electron emission source width.

4. The electron emission device of claim 3, wherein the opening portions and the electron emission sources are rectangular-shaped.

5. The electron emission device of claim 3, wherein the opening portions and the electron emission sources are oval-shaped.

6. The electron emission device of claim 1, wherein two or more of the opening portions and the electron emission sources are arranged at the crossed regions of the cathode electrodes and the gate electrodes parallel to each other while proceeding in the first direction.

7. The electron emission device of claim 1, wherein the opening portions comprise a first opening portion formed at the insulation layer and a second opening portion formed at the gate electrode, and the second opening portion has an extension exposing the surface of the insulation layer.

8. The electron emission device of claim 7, wherein the first opening portion is rectangular-shaped, and the extension of the second opening portion is located outside and adjacent the long-sided edges of the first opening portion.

9. The electron emission device of claim 1, wherein the electron emission sources are formed with one or more elements selected from the group consisting of carbon nanotube, graphite, diamond, diamond-like carbon, $C_{60}$, or a combination thereof.

10. The electron emission device of claim 1, wherein the electron emission sources are formed with one or more elements selected from the group consisting of nano-wire, nano-fiber, nano-tube, or a combination thereof.

11. The electron emission device of claim 1, further comprising a grid electrode having beam-guide holes and placed between the first and the second substrates.

12. The electron emission device of claim 11, wherein the grid electrode has the beam-guide holes arranged at the sub-pixel regions defined over the first substrate in a one to one correspondence.

13. An electron emission device comprising:

a first substrate and a second substrate facing each other at a predetermined distance therebetween;

cathode electrodes and gate electrodes formed on the first substrate and crossing each other with an insulation layer interposed between the cathode electrodes and the gate electrodes;

opening portions formed at the gate electrodes and at the insulation layer exposing the cathode electrodes;

electron emission sources formed on cathode electrodes exposed through the opening portions, each electron emission source having an area smaller than an area of each opening portion;

an anode electrode formed on the second substrate; and phosphor layers formed on the anode electrode, each phosphor layer having a phosphor layer length extending in a first direction and a phosphor layer width extending in a second direction, the phosphor layer length being greater than the phosphor layer width;

wherein the electron emission sources each have an electron emission source length extending in the second direction and an electron emission source width extending in the first direction, the electron emission source length being greater than the electron emission source width.

14. The electron emission device of claim 13, wherein a distance in the first direction between a respective gate electrode and a width edge of each electron emission source is less than a distance in the second direction between the respective gate electrode and a length edge of each electron emission source.

15. The electron emission device of claim 13, wherein two or more of corresponding openings and electron emission sources are arranged at respective sub-pixel regions in the first direction.

* * * * *